United States Patent [19]

Garyga

[11] Patent Number: 4,787,234

[45] Date of Patent: Nov. 29, 1988

[54] METHOD AND APPARATUS FOR EXTRUDING SUPERALLOY MATERIAL

[75] Inventor: Stéphane C. G. Garyga, Bessancourt, France

[73] Assignee: Societe Nationale D'Etude et de Construction de Moteurs D'Aviation "S.N.E.C.M.A.", France

[21] Appl. No.: 133,894

[22] Filed: Dec. 16, 1987

[30] Foreign Application Priority Data

Dec. 17, 1986 [FR] France ..... 86 17635

[51] Int. Cl.[4] ..... B21C 23/04; B21C 33/00; B21C 35/00

[52] U.S. Cl. ..... 72/263; 72/270; 72/272

[58] Field of Search ..... 72/253.1, 263, 270, 72/272

[56] References Cited

U.S. PATENT DOCUMENTS

| | | | |
|---|---|---|---|
| 2,860,775 | 11/1958 | Brauchler | 72/272 |
| 2,954,869 | 10/1960 | Swanson | 72/263 |

FOREIGN PATENT DOCUMENTS

| | | | |
|---|---|---|---|
| 542045 | 1/1932 | Fed. Rep. of Germany . | |
| 1068583 | 6/1954 | France . | |
| 1318691 | 1/1963 | France . | |
| 57-134211 | 8/1982 | Japan | 72/272 |
| 909189 | 10/1962 | United Kingdom . | |

*Primary Examiner*—Lowell A. Larson
*Attorney, Agent, or Firm*—Bacon & Thomas

[57] ABSTRACT

The present invention provides a method and apparatus for a forwardly extruding superalloy parts. The method provides for extruding metal parts from a superalloy material in an extrusion press having a lower press table assembly accommodating the extruded part; and extrusion pot and an extrusion die located on the lower press table assembly; and an upper plunger reciprocally movable with respect to the lower press table having an extrusion punch mounted thereon. The method encompasses the steps of: laterally displacing the lower press table assembly and extrusion pot from the reciprocating axis of the upper plunger; placing an extrusion billet of superalloy material in the extrusion pot; placing a spacer on an upper surface of the extrusion billet; moving the lower press table assembly into alignment with the upper plunger such that the extrusion die is substantially coaxial with the reciprocating axis; extending the upper plunger along its reciprocating axis such that the extrusion punch enters the extrusion pot so as to extrude the superalloy material through the extrusion die; fixedly attaching the extrusion pot to the upper plunger; retracting the upper plunger so as to remove it and the extrusion pot from the lower press table assembly; laterally displacing the lower press table assembly from alignment with the reciprocating axis; and removing the extrusion die and extruded part from the lower press table assembly. The apparatus for carrying out this method has an upper plunger with an extrusion punch and is reciprocally movable along a reciprocating axis; a lower press table assembly having an extrusion die and adapted to move laterally with respect to the reciprocating axis; an extrusion pot located on the lower press table assembly defining an opening therethrough coaxially aligned with the extrusion die to accommodate a billet of superalloy materials.

10 Claims, 10 Drawing Sheets

METHOD AND APPARATUS FOR EXTRUDING SUPERALLOY MATERIAL

BACKGROUND OF THE INVENTION

The present invention relates to a method and apparatus for directly extruding a superalloy material on a vertical forging press.

Extrusion methods and apparatus for forming mechanical parts by extrusion are well known in the art. Typically, the apparatus comprises an extrusion die through which a billet or blank of material is forced by a punch or plunger. The billet or blank is usually at elevated temperatures to facilitate the flow of the material through the extrusion die. The extrusion process is designated as a "forward" extrusion when the extruded part leaving the extrusion die moves in the same direction as the force exterted on the plunger or punch.

It is possible using the known extrusion apparatus and methods to manufacture parts of great lengths, such as pipes or structural elements having various cross-sectional shapes. The great lengths of these parts usually necessitates that the part moves in a substantially horizontal direction when leaving the extrusion die.

It is also possible to manufacture certain aircraft jet engine parts by extrusion, such as large diameter collars or rings which form part of the engine mounting structure and which are provided with a contoured cross section. These parts may be manufactured by extrusion,followed by rolling and welding operations.

However, up to now it has not been possible to manufacture parts for high performance turbine jet engines. These engines typically operate at higher temperatures and are subject to greater internal stresses thereby necessitating certain parts to be made of a superalloy material, such as a nickel based superalloy. The difficulty in forming parts from superalloy materials has prohibited the use of extrusion methods and apparatus.

SUMMARY OF THE INVENTION

It is an object of the present invention to provide a method and apparatus for forwardly extruding superalloy parts. The invention may be utilized in a vertical forging press which may have the necessary force of up to 65,000 tons.

The method of the invention provides for extruding metal parts from a superalloy material in an extrusion press having a lower press table assembly defining means to accommodate the extruded part; an extrusion pot and an extrusion die located on the lower press table assembly; and an upper plunger reciprocally movable with respect to the lower press table having an extrusion punch mounted thereon. The method encompasses the steps of: laterally displacing the lower press table assembly and extrusion pot from the reciprocating axis of the upper plunger; placing an extrusion billet of superalloy material in the extrusion pot; placing a spacer on an upper surface of the extrusion billet; moving the lower press table assembly into alignment with the upper plunger such that the extrusion die is substantially coaxial with the reciprocating axis; extending the upper plunger along its reciprocating axis such that the extrusion punch enters the extrusion pot so as to extrude the superalloy material through the extrusion die; fixedly attaching the extrusion pot to the upper plunger; retracting the upper plunger so as to remove it and the extrusion pot from the lower press table assembly; laterally displacing the lower press table assembly from alignment with the reciprocating axis; and, removing the extrusion die and the extruded part from the lower press table assembly.

The apparatus for carrying out this method may comprise: an upper plunger having an extrusion punch fixedly mounted thereon so as to be reciprocally movable along a reciprocating axis; a lower press table assembly having an extrusion die attached thereto and adapted to move laterally with respect to the reciprocating axis; an extrusion pot assembly located on the lower press table assembly defining an opening therethrough coaxially aligned with the extrusion die to accommodate a billet of superalloy material; means to extend the upper plunger toward the lower press table assembly such that the extrusion punch forces the superalloy material through the extrusion die to form the extruded part; attachment means to attach the upper plunger to the extrusion pot; means to retract the upper plunger and the extrusion pot from the lower press table assembly; means to laterally displace the lower press table assembly from the reciprocating axis; and, means to remove the extruded part from the lower press table assembly.

The invention also provided a method for removing the part from the extrusion pot should the part become attached thereto during the retraction of the upper plunger and the extrusion pot from the lower press table assembly.

The apparatus according to the method also comprises a generally cylindrical bushing slidably located in the lower press table assembly having an open end coaxially aligned with the extrusion die opening and a closed opposite end so as to accommodate the extruded part therein. The bushing may be raised with respect to the lower press table assembly to remove the extruded part therefrom.

DETAILED DESCRIPTION OF THE PREFERRED EMBODIMENT

Figure 1:
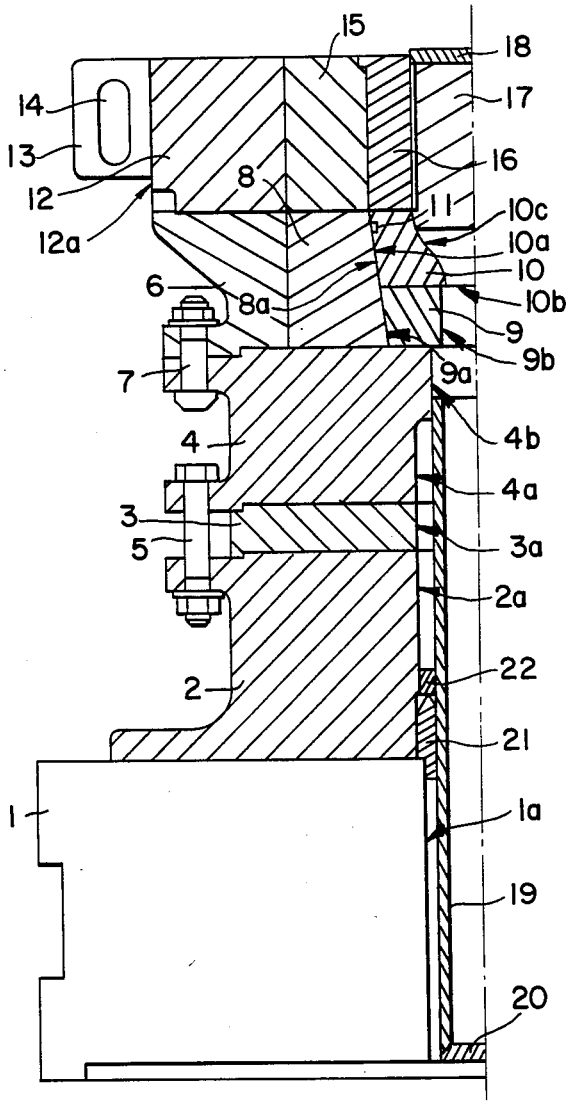
FIG. 1 is a partial, vertical cross-sectional view taken through the center of a lower press table assembly according to the invention.

As seen in FIG. 1, the lower press table assembly according to the invention comprises a support base 1 on which is mounted lower frame 2 by any known attaching means. An intermediate spacer 3 is located on a upper surface of lower frame 2 between the frame 2 and upper frame 4. Upper frame 4 is attached to lower frame 2 via bolts 5 or the like.

Upper frame 4 supports external die pot 6 and is attached thereto via bolts 7 or the like. An intermediate die pot 8 is also supported on upper frame 4 and is arranged generally concentrically to external pot 6. A die plate 9 and an extrusion die 10 are mounted in bore **8*a* formed in die pot 8. The bore 8*a* and the cooperating diameters 9*a* and 10*a* of the die plate 9 and the extrusion die 10 define complimentary conical surfaces, as shown in FIG. 1 to facilitate the removal of the die plate and the extrusion die from the die pot 8**.

Bore **9*b* extending through die plate 9 is slightly larger than the extrusion orifice 10*b* formed in the extrusion die 10 to allow passage of the extruded part through the die plate 9 without interference. Surface 10*c* is formed on the interior of extrusion die 10 so as to facilitate the extrusion of the superalloy billet 17 therethrough. Outer surface 10*a* of the extrusion die 10 defines at least two holes 11** which may be utilized to attach means to remove the extrusion die from the lower press table assembly.

An extrusion pot assembly is located on upper surfaces of the external die pot 6 and the intermediate die pot 8 and comprises an upper external pot 12, an extrusion pot 15 and a die block 16. External pot 12 has at least two flanges 13 extending generally laterally from exterior surface **12*a*, each of the flanges 13 defining an elongated opening 14. A billet of extrudable superalloy material 17 is placed within die block 16 and a support spacer 18 is placed on an exposed upper surface of the billet 17**.

The support base 1, the lower frame 2, the spacer 3 and the upper frame 4 each define a central bore denoted by elements **1*a*, 2*a*, 3*a* and 4*a*, respectively, inside of which a generally cylindrical bushing 19 is located. The bushing 19 has an open upper end which is coaxially arranged with the extrusion orifice 10*b*, and has a closed lower end 20. The bushing is hollow so as to enable the extruded part to be completely accommodated within the bushing 19**.

Bushing 19 is slidably mounted within the bore and is guided by surface **4*b* at its upper portion and a spacer 21 extending between the bore 1*a* and 2*a*. Retaining clip 22 fixedly attached to the bushing 19 cooperates with the bores 2*a*, 3*a* and 4*a* so as to laterally guide the bushing and to limit its upward travel. Means (not shown) are incorporated into the lower press table assembly to raise and lower the bushing 19 with respect to the lower press table assembly. As will be seen hereafter, bushing 19** is raised so as to facilitate the removal of the extruded part from the lower press table assembly.

As shown in FIG. 1, the lower press table assembly is laterally displaced from a reciprocating axis of an upper plunger so as to facilitate the insertion of the billet 17 and the spacer 18. Following this insertion, the lower press table assembly is displaced laterally to the position shown in FIG. 2 such that the longitudinal axis of the extrusion die 10 is substantially concentric with the reciprocating axis of the upper plunger 23 and punch 29. Upper plunger 23 has distribution plate 24 fixedly joined thereto which, in turn, has punch support plate 26 mounted thereon via bolts 25 or the like. Screws 27 serve to attach collar 28 to the punch support plate 26. Collar 28 affixes punch 29 to the punch support plate 26 and serves to limit the lower stroke of the upper plunger by contacting extrusion pot 15. Upper plate 24 has at least two tie bars 31 attached thereto via shaft 30. Tie bars 31 each define a hole 32 so as to facilitate the attachment of the upper plunger 23 to the extrusion pot assembly as will be described in more detail hereafter.

Figure 2:
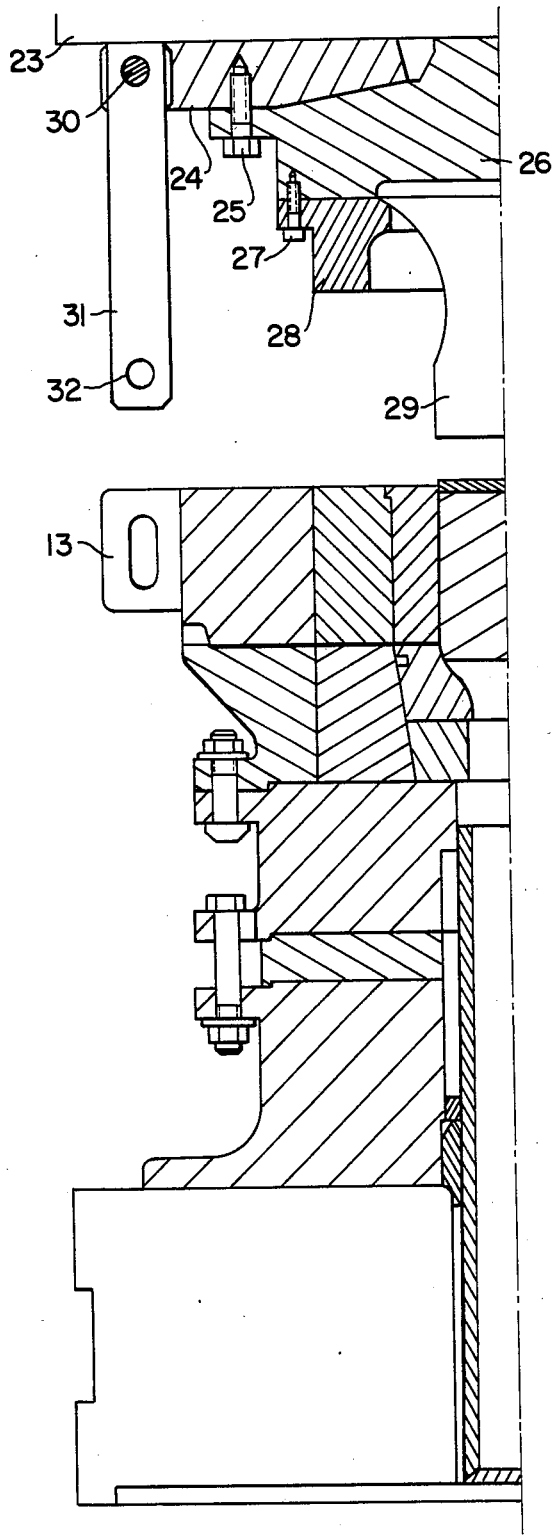
FIG. 2 is a partial, vertical cross-sectional view showing the lower press table assembly of FIG. 1 laterally displaced under an upper plunger of a forging press.
Figure 3:
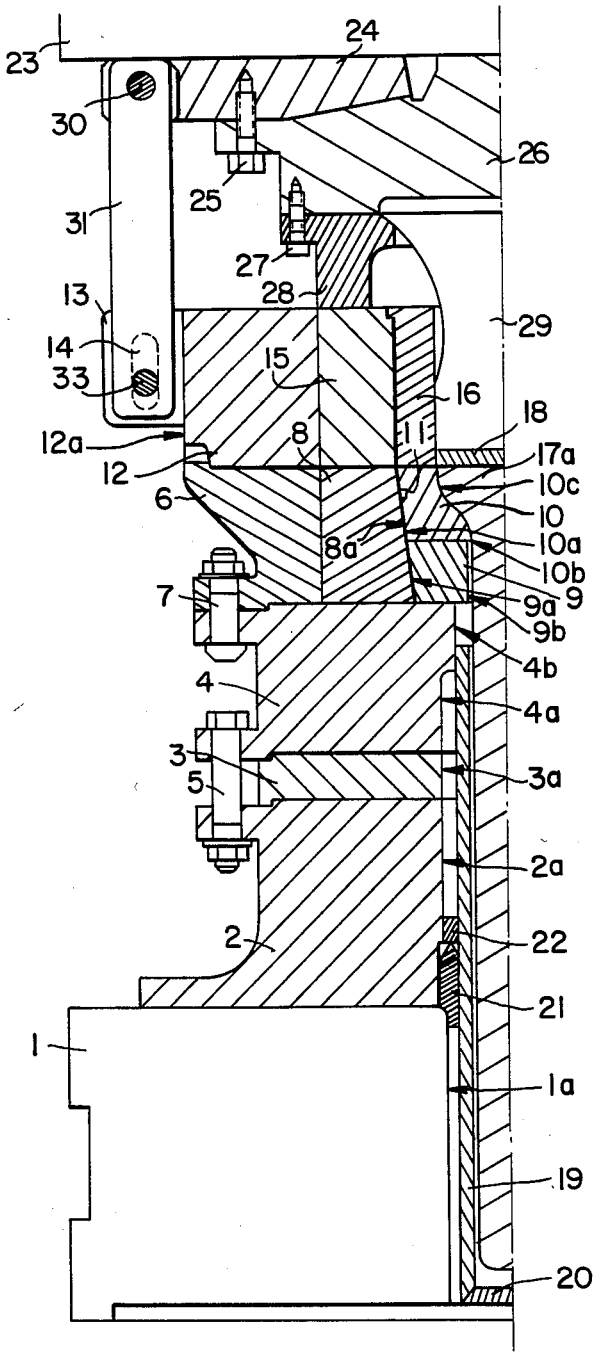
FIG. 3 is a cross-sectional view similar to FIG. 2 with the upper plunger lowered so as to extrude the superalloy material through the extrusion die.

Once the lower press table assembly has been laterally moved to the position shown in FIG. 2, the upper plunger 23 is lowered such that punch 29 enters the die block 16 so as to force the superalloy material 17 through the extrusion die 10 to form the extruded part **17*a* located in the bushing 19 as shown in FIG. 3. The stroke of the upper plunger 23 is limited by contact between collar 28 and extrusion pot 15**.

Figure 4:
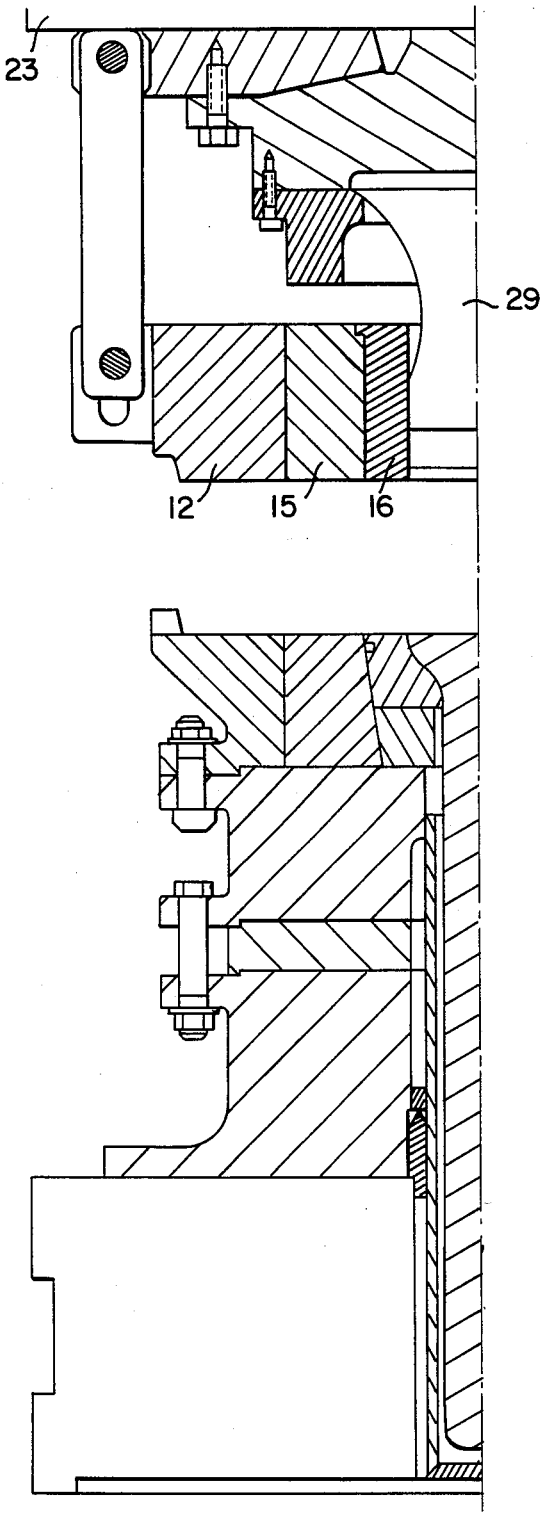
FIG. 4 is a partial, cross-sectional view similar to FIG. 3, showing the upper plunger and extrusion pot displaced upwardly from the lower press table assembly.
Figure 9:
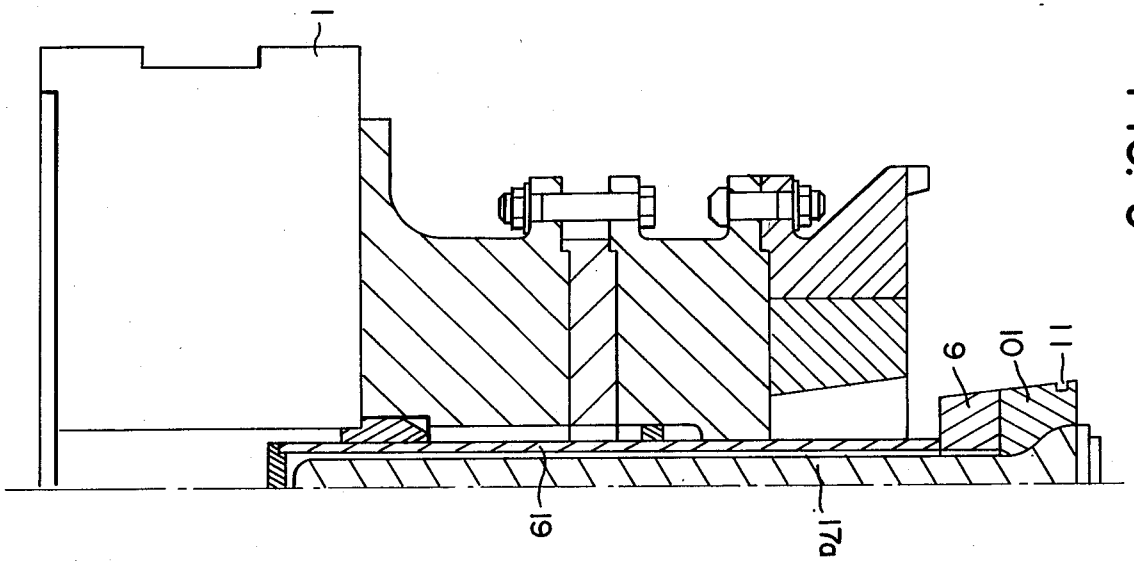
FIG. 9 is a partial, vertical cross-sectional view of the lower press table assembly in FIG. 8 laterally displaced from the upper plunger and showing the bushing and extruded part raised with respect to the lower press table assembly so as to facilitate the removal of the extruded part therefrom.

Once the plunger 23 has reached the end of its downward stroke, the hole 32 is aligned with slot 14. A pin 33 is inserted through these openings so as to fixedly attach the extrusion pot assembly on the upper plunger. The upper plunger 23 is then retracted, as shown in FIG. 4, such that it removes the extrusion pot assembly from the lower press table assembly. The lower press table assembly is then once again laterally displaced from the reciprocating axis of the upper plunger 23 and the bushing 19 is raised so as to raise the extruded part, the die plate 9 and the extrusion die 10 as indicated in FIG. 9. Known means are then inserted in the openings 11 so as to remove the extrusion die 10 and with the extruded part **17*a*** from the lower press table assembly.

Figure 5:
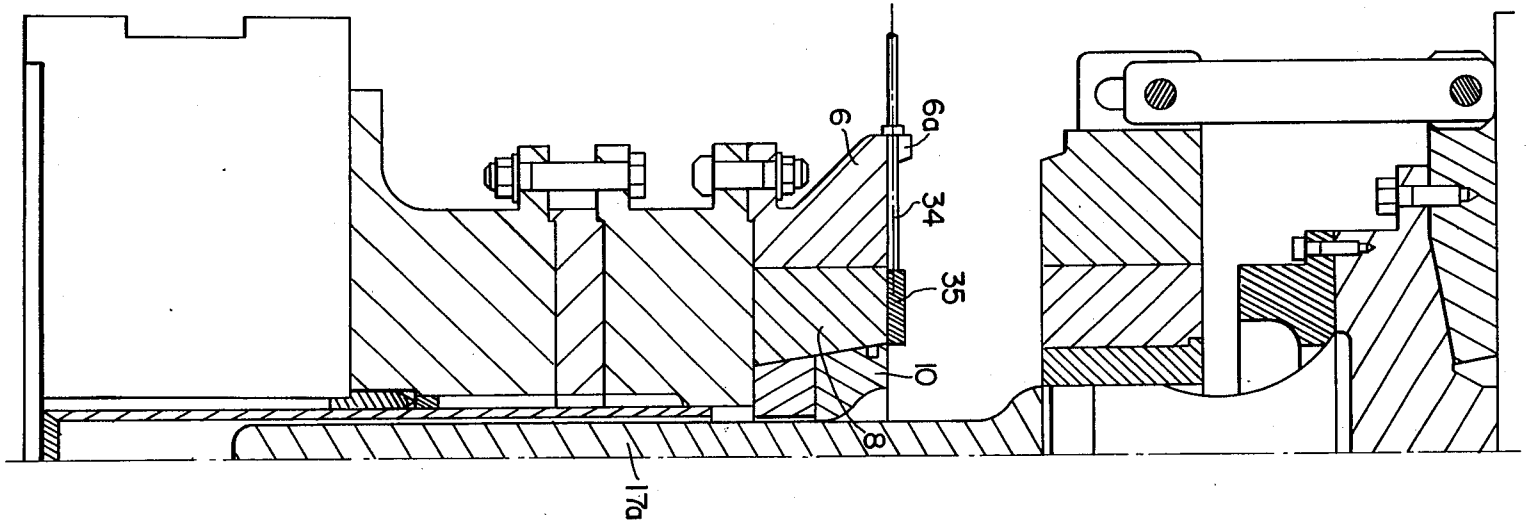
FIG. 5 is a partial, cross-sectional view similar to FIG. 4, showing a spacer placed on the lower press table assembly and the extruded part attached to the extrusion pot.
Figure 6:
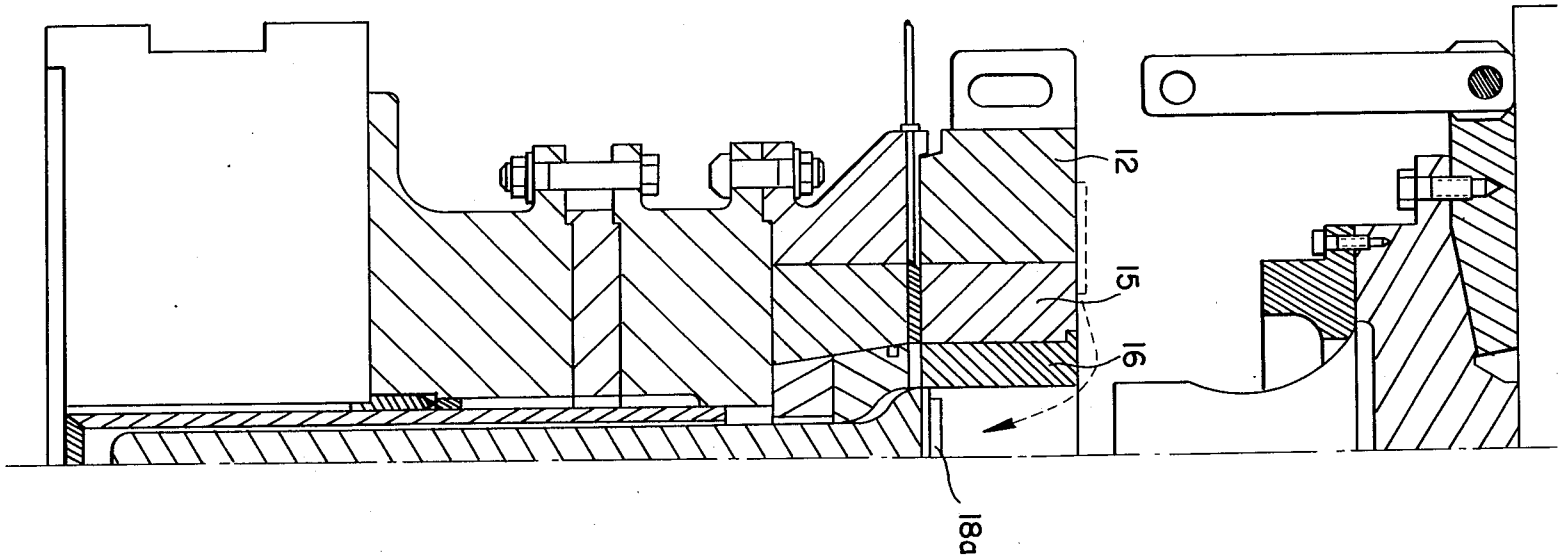
FIG. 6 is a partial, cross-sectional view similar to FIG. 5 showing the extrusion pot lowered onto the spacer and the upper plunger raised therefrom.
Figure 7:
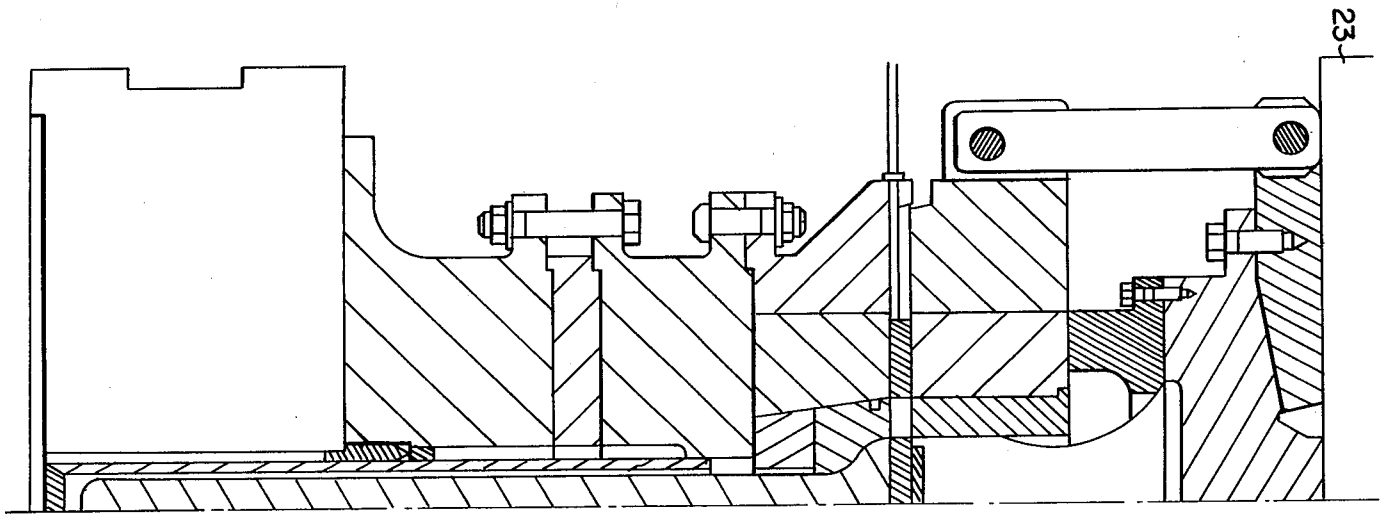
FIG. 7 is a partial, cross-sectional view similar to FIG. 6, showing the upper plunger lowered so as to completely force the extruded part out of the extrusion pot.
Figure 8:
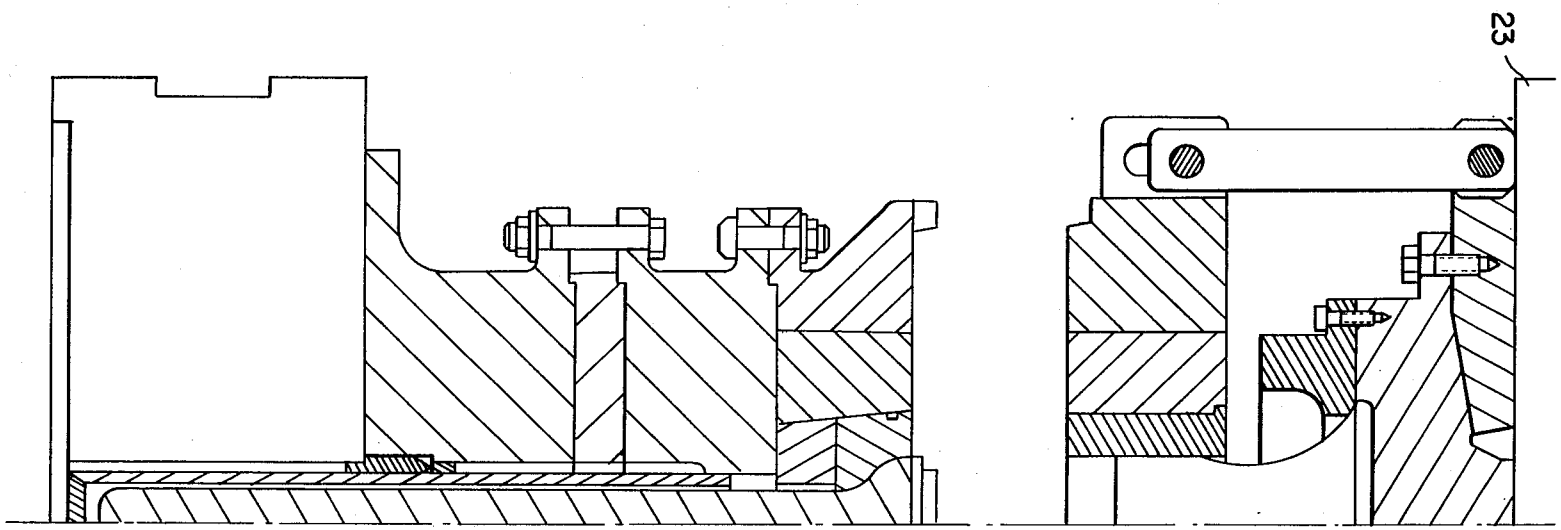
FIG. 8 is a partial, cross-sectional view showing the method step after FIG. 7 wherein the upper plunger and extrusion pot are raised from the lower press table assembly.

During the extrusion process, the upper part of the extrusion **17*a* sometimes becomes afixed to the lower edge of die block 16 such that, as the upper plunger 23 and extrusion pot assembly are raised, the extruded part 17*a* is pulled partially out of bushing 19 as illustrated in FIG. 5. In this instance, a secondary support spacer 35 is placed on top of the intermediate die pot 8 and is located by bar 34 bearing against protrusion 6*a* formed on the external die pot 6. The upper plunger 23 and the extrusion pot assembly are then lowered until the extrusion pot assembly rests on the support spacer 35. Tie bars 31 are then disengaged from the extrusion pot assembly and the upper plunger 23 is raised as shown in FIG. 6. An adjustment shim 18*a* is placed on top of the support spacer 18. Upon lowering the upper plunger 23, the plunger 29 bears against adjustment shim 18*a* to force the extruded part 17*a* completely out of the die block 16, as shown in FIG. 7. The tie bars 31 are then reattached to the extrusion pot assembly via pins 33 and the upper plunger 23 and the extrusion pot assembly are raised as shown in FIG. 8. The lower press table assembly is then moved laterally and the process proceeds as previously described in reference to FIGS. 9 and 10**.

Figure 10:
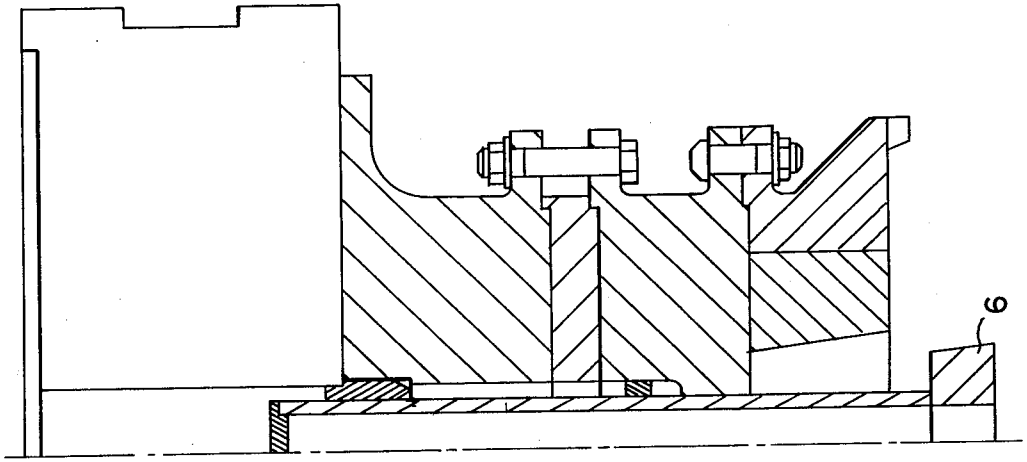
FIG. 10 is a partial, cross-sectional view similar to FIG. 9 showing the extruded part and extrusion die removed from the lower press table assembly.

Once the extruded part **17*a* has been removed, as shown in FIG. 10, the bushing 19 is lowered and an extrusion die 10 is reinserted on the die plate 9. The lower press table assembly is displaced laterally to a position beneath the upper plunger 23. The plunger 23 is lowered until the extrusion pot assembly rests on the lower press table assembly and the tie bars 31 are disconnected therefrom. Following the raising of the upper plunger 23 to the position shown in FIG. 2**, the lower press table assembly is once again laterally displaced and is ready for use with a subsequent superalloy billet.

I claim:

1. A forward extrusion, method for extruding metal parts from superalloy material in a forward extrusion press having a lower press table assembly defining means to accommodate the extruded part, an extrusion pot assembly including an extrusion pot and an extrusion die located on the lower press table, and an upper plunger reciprocally movable along a reciprocating axis with respect to the lower press table having an extrusion punch mounted thereon, the method comprising the steps of:

(a) laterally displacing the lower press table assembly and extrusion pot assembly from the reciprocating axis of the upper plunger;

(b) placing an extrusion billet of superalloy material in the extrusion pot;

(c) placing a spacer on an upper surface of the extrusion billet;

(d) moving the lower press table assembly into alingment with upper plunger such that the extrusion die is substantially coaxial with the reciprocating axis;

(e) extending the upper plunger along its reciprocating axis such that the extrusion punch enters the extrusion pot so as to extrude the superalloy material through the extrusion die;

(f) fixedly attaching the extrusion pot assembly to the upper plunger;

(g) retracting the upper plunger so as to remove the extrusion pot assembly from the lower press table assembly;

(h) laterally displacing the lower press table assembly from alignment with the reciprocating axis; and, (i) removing the extrusion die and the extruded part from the lower press table assembly.

2. The extrusion method according to claim 1 comprising the additional steps of:

(a) placing second spacer means on a surface of the lower press table assembly after retracting the upper plunger and removing the extrusion pot assembly from the lower press table assembly;

(b) placing the extrusion pot assembly onto the lower press table assembly such that it rests on the second spacer means;

(c) detaching the upper plunger from the extrusion pot assembly;

(d) retracting the upper plunger;

(e) placing an adjustment shim in the extrusion pot assembly such that it rests on a surface of the extruded part;

(f) extending the upper plunger such that the extrusion plunger pushes the extruded part out of the extrusion pot assembly; and (g) proceeding with steps (f) thru (i) of claim 1.

3. The extrusion method according to claim 1 wherein the step of fixedly attaching the extrusion pot to the upper plunger comprises:

(a) attaching a first end of at least one tie bar to the upper plunger; and (b) attaching a second end of at least one tie bar to the extrusion pot.

4. Apparatus for forwardly extruding a metallic superalloy material comprising:

(a) an upper plunger having an extrusion punch fixedly mounted thereon, the upper plunger and extrusion punch being reciprocally movable along a reciprocating axis;

(b) a lower press table assembly having an extrusion die attached thereto and adapted to move laterally between a first position wherein the extrusion die is laterally displaced from the reciprocating axis and a second position wherein the extrusion die is substantially coaxial with the reciprocating axis;

(c) an extrusion pot located on the lower press table assembly defining an opening therethrough coaxially aligned with the extrusion die to accommodate a billet of superalloy material;

(d) means to extend the upper plunger toward the lower press table assembly such that the extrusion punch forces the superalloy material through the extrusion die to form an extruded part;

(e) attachment means to attach the upper plunger to the extrusion pot;

(f) means to retract the upper plunger and the extrusion pot from the lower press table assembly;

(g) means to move the lower press table assembly to its first position laterally displaced from the reciprocating axis; and (h) means to remove the extruded part from the lower press table assembly.

5. The apparatus according to claim 4 wherein the attachment means comprises:

(a) a plurality of tie bars attached to the upper plunger; and, (b) fastening means to fasten the tie bars to the extrusion pot.

6. The apparatus according to claim 5 wherein the fastening means comprises:

(a) a hole defined in each of the tie bars;

(b) a connecting flange located on the extrustion pot, the flange defining an opening therethrough; and, (c) pin means extending through the hole and the opening so as to affix the tie bar to the connecting flange.

7. The apparatus according to claim 4 further comprising:

(a) a bore defined by the lower press table in substantial coaxial alignment with the extrusion die; and, wherein the means to remove comprises (b) a bushing slidably located in the bore and having an open end facing the extrusion die so as to accommodate the extruded part passing through the extrusion die and a closed, opposite end.

8. The apparatus according to claim 7 further comprising means to reciprocate the bushing along a longitudinal axis relative to the lower press table assembly to facilitate removal of the extruded part therefrom.

9. The apparatus according to claim 8 wherein the attachment means comprises:

(a) a plurality of tie bars attached to the upper plunger; and, (b) fastening means to fasten the tie bars to the extrusion pot.

10. The apparatus according to claim 9 wherein the fastening means comprises:

(a) a hole defined in each of the tie bars;

(b) a connecting flange located on the extrusion pot, the flange defining an opening therethrough; and, (c) pin means extending through the hole and the opening so as to affix the tie bar to the connecting flange.

* * * * *

UNITED STATES PATENT AND TRADEMARK OFFICE

CERTIFICATE OF CORRECTION

PATENT NO. : 4,787,234

DATED : November 29, 1988

INVENTOR(S) : Stephane C. G. GARYGA

It is certified that error appears in the above-identified patent and that said Letters Patent is hereby corrected as shown below: Title page:

IN THE ABSTRACT - The first sentence should read --The present invention provides a method and apparatus for forwardly extruding superalloy parts.--

Col. 3, line 17, "a" should be --an--.

Col. 4, line 33, "on" should be --to--.

Col. 5, line 28, "alingment" should be --alignment--.

Col. 6, line 38, "extrustion" should be --extrusion--.

In claim 7, line 47, after "remove" insert --the extruded part--.

Signed and Sealed this

Second Day of May, 1989

*Attest:*

DONALD J. QUIGG

*Attesting Officer*

*Commissioner of Patents and Trademarks*